US009151209B2

(12) United States Patent
Higaki

(10) Patent No.: US 9,151,209 B2
(45) Date of Patent: Oct. 6, 2015

(54) OILING STRUCTURE FOR ENGINE

(71) Applicant: SUZUKI MOTOR CORPORATION, Shizuoka (JP)

(72) Inventor: Tomoyuki Higaki, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 13/966,398

(22) Filed: Aug. 14, 2013

(65) Prior Publication Data

US 2014/0076248 A1 Mar. 20, 2014

(30) Foreign Application Priority Data

Sep. 20, 2012 (JP) ..... 2012-207147

(51) Int. Cl.

| | |
|---|---|
| ***F01L 1/18*** | (2006.01) |
| ***F01M 9/10*** | (2006.01) |
| ***F01M 3/04*** | (2006.01) |
| ***F01M 1/06*** | (2006.01) |
| ***F01L 1/02*** | (2006.01) |
| ***F01P 3/02*** | (2006.01) |
| ***F01L 1/053*** | (2006.01) |
| ***F01L 1/24*** | (2006.01) |
| *F01L 1/047* | (2006.01) |

(52) U.S. Cl.

CPC . *F01P 3/02* (2013.01); *F01L 1/053* (2013.01); *F01L 1/2405* (2013.01); *F01M 9/10* (2013.01); *F01M 9/102* (2013.01); *F01L 1/185* (2013.01); *F01L 2001/0476* (2013.01); *F01L 2001/0537* (2013.01); *F01L 2105/00* (2013.01); *F01L 2810/02* (2013.01)

(58) Field of Classification Search

CPC .. F02B 2275/18; F02B 2275/20; F01L 1/053; F01L 1/2405; F01L 1/22; F01L 1/20; F01L 1/245; F01L 1/14; F01L 1/185; F01L 1/181; F01M 9/104

USPC ..... 123/41.72, 90.33, 90.27, 90.25, 90.12, 123/90.17, 90.43, 90.45, 90.46, 90.52, 123/90.55, 196 M, 196 R, 198 E

See application file for complete search history.

(56) References Cited

U.S. PATENT DOCUMENTS

| | | | | |
|---|---|---|---|---|
| 5,031,586 | A * | 7/1991 | Masuda et al. | 123/90.27 |
| 5,423,295 | A * | 6/1995 | Murata et al. | 123/90.16 |
| 5,913,293 | A * | 6/1999 | Ochiai | 123/90.33 |
| 2008/0264366 | A1 * | 10/2008 | Hashimoto | 123/90.17 |

FOREIGN PATENT DOCUMENTS

JP 5-306603 A 11/1993

OTHER PUBLICATIONS

The First Office Action mailed Jun. 2, 2015 in corresponding Chinese Patent Application No. 201310378879.9 (with an English translation) (14 pages).

* cited by examiner

*Primary Examiner* — Lindsay Low
*Assistant Examiner* — Syed O Hasan
(74) *Attorney, Agent, or Firm* — Rothwell, Figg, Ernst & Manbeck, P.C.

(57) ABSTRACT

A lower cam housing is formed to be a separate body from a cylinder head and the lower cam housing is arranged at a joint surface of the cylinder head, a first upper oil passage reaching from an oil entry passage to the joint surface is formed inside the cylinder head and an upstream end of the first upper oil passage is opened at the joint surface, and a second upper oil passage through which the oil reaches to the joint surface via an upper side than the joint surface is formed in the lower cam housing, where an upstream end of the second upper oil passage is in communication with the oil entry passage side at the joint surface, and a downstream end of the second upper oil passage is in communication with the first upper oil passage at the joint surface.

3 Claims, 14 Drawing Sheets

OILING STRUCTURE FOR ENGINE

CROSS-REFERENCE TO RELATED APPLICATION

The present application claims the benefit of priority to Japanese Patent Application No. 2012-207147, filed on Sep. 20, 2012, the entire content of which is incorporated herein by reference.

FIELD OF THE INVENTION

The present invention relates to an oiling structure for engine, and more specifically, to an oiling structure for supplying oil to a hydraulic lash adjuster.

BACKGROUND OF THE INVENTION

In general, in an engine in which the opening and closing of a valve is carried out by a swinging rocker arm, a plurality of hydraulic lash adjusters (referred hereafter as lash adjusters) are arranged along a direction (a length direction) in which cylinders are arranged. This lash adjuster is made such that oil is supplied at a prescribed pressure from an oil pump arranged at a lower portion of the engine. Then, the lash adjuster has an effect of canceling the valve clearance caused by the thermal expansion of the valve, for example, by adjusting a position of the valve by utilizing the oil pressure of the oil during the engine operation. In the lash adjuster, an oil passage for the oil pumped from the oil pump of the engine is passing. The oil passage is formed in the cylinder block and the cylinder head. In the conventional engine, the oil passage formed in the cylinder head such that it is in communication with the oil pump side is positioned at a lower position than the oil passage to the lash adjuster. For this reason, in the conventional engine, the oil present in the oil passage from the oil pump to the lash adjuster at a time of the engine stop has been such that it flows down to the lower portion side of the engine, via this oil passage. Consequently, in the conventional engine, the sufficient oil is not supplied to the lash adjuster at a time of the engine re-start, which becomes a cause for generating a remaining air inside a hydraulic chamber inside the lash adjuster, and there has been a danger of adversely affecting the opening and closing of the valve.

As a measure against such a problem, there is known a lubrication device in which the oil passage provided toward the lash adjuster from the lower portion side of the cylinder head is equipped with an upper oil passage extending to an upper side than the lash adjuster, and a return oil passage that returns from this upper oil passage to a lower side and reaches to the lash adjuster (see Japanese Patent Application Publication No. H5-306603, for example). In this lubrication device, the oil supply to the lash adjuster from the return oil passage becomes possible at a time of the engine re-start. In this prior art, the oil is supplied to both the lash adjuster of the intake side (also referred to as the air intake herein) and the lash adjuster of the exhaust side, so that a communication pipe for making the oil passage of the air intake side and the oil passage of the exhaust side in communication is added to a space inside the cylinder head cover. At the both end portions of this communication pipe, flanges are provided, and these flanges are fixed to an upper end surface of the cylinder head by bolts.

However, in the above noted prior art, the communication pipe is arranged in a space between the upper end surface of the cylinder head and the cylinder head cover, so that it has been one in which the communication pipe is easily oscillated by the vibration of the engine. For this reason, at the flanges of the both end portions of the communication pipe, there has been a danger of having the oil flowing out due to the loosening of the bolts. Also, in such a prior art, the assembling work for bolting the communication pipe to the upper end surface of the cylinder head is cumbersome.

SUMMARY OF THE INVENTION

The present invention is one that has been made in view of the above noted problems, and has an object to provide the oiling structure for engine with a high productivity, capable of preventing the outflow of oil inside a hydraulic lash adjuster after the engine stop, and preventing the generation of the engine noise (tappet sound) at a time of the re-start.

In order to solve the above described problems and achieve the object, a form of the present invention is an oiling structure for engine, including a cylinder head of the engine having a cam shaft, a rocker arm for swinging in conjunction with a rotation of the cam shaft, a valve for carrying out an opening and closing operation in conjunction with the swinging of the rocker arm, and plural pairs of cam housings formed by lower cam housings and upper cam housings, for sandwiching and axially supporting the cam shaft to be freely rotatable, wherein one end of the rocker arm is supported to be capable of swinging via a hydraulic lash adjuster, oil ejected from an oil pump is guided to an oil hole of the lash adjuster in the cylinder head, and an oil passage for the lash adjuster is formed in the cylinder head at the same height (or at an identical level) as the oil hole. In addition, at least one of the lower cam housings is formed as a separate body from the cylinder head joined to the cylinder head at a joint surface (the joint surface can also be referred to as a joint surface rejoin or region of the joint surface herein, referring to the region at which the separate body is joined to the cylinder head). Further, a first upper oil passage extends from the oil passage for the lash adjuster to the joint surface and is formed inside the cylinder head, and an upstream end of the first upper oil passage is opened at the joint surface region. An oil entry passage for supplying the oil ejected from the oil pump is formed inside the cylinder head, and a downstream end of the oil entry passage is opened at the joint surface, and a second upper oil passage through which the oil reaches to the joint surface from above the joint surface is formed in the lower cam housing, where an upstream end of the second upper oil passage is in communication with the oil entry passage at the joint surface, and a downstream end of the second upper oil passage is in communication with the first upper oil passage at the joint surface.

As the above noted form, it is preferable that the oil passage for the lash adjuster comprises an air intake side oil passage for the lash adjuster which is in communication with the lash adjuster that is to be used at an air intake side, and an exhaust side oil passage for the lash adjuster which is in communication with the lash adjuster that is to be used at an exhaust side, and the second upper oil passage is in communication with each of the first upper oil passage on the air intake side and the first upper oil passage on the exhaust side.

According to the present invention, it is possible to realize the oiling structure for engine with a high productivity, capable of preventing the outflow of oil inside a hydraulic lash adjuster after the engine stop, and preventing the generation of the engine noise (tappet sound) at a time of the re-start.

DETAILED DESCRIPTION OF THE INVENTION

In the following, the detail of the oiling structure for engine according to embodiments of the present invention will be described based on the drawings.

(Schematic Configuration of an Engine)

Figure 1:
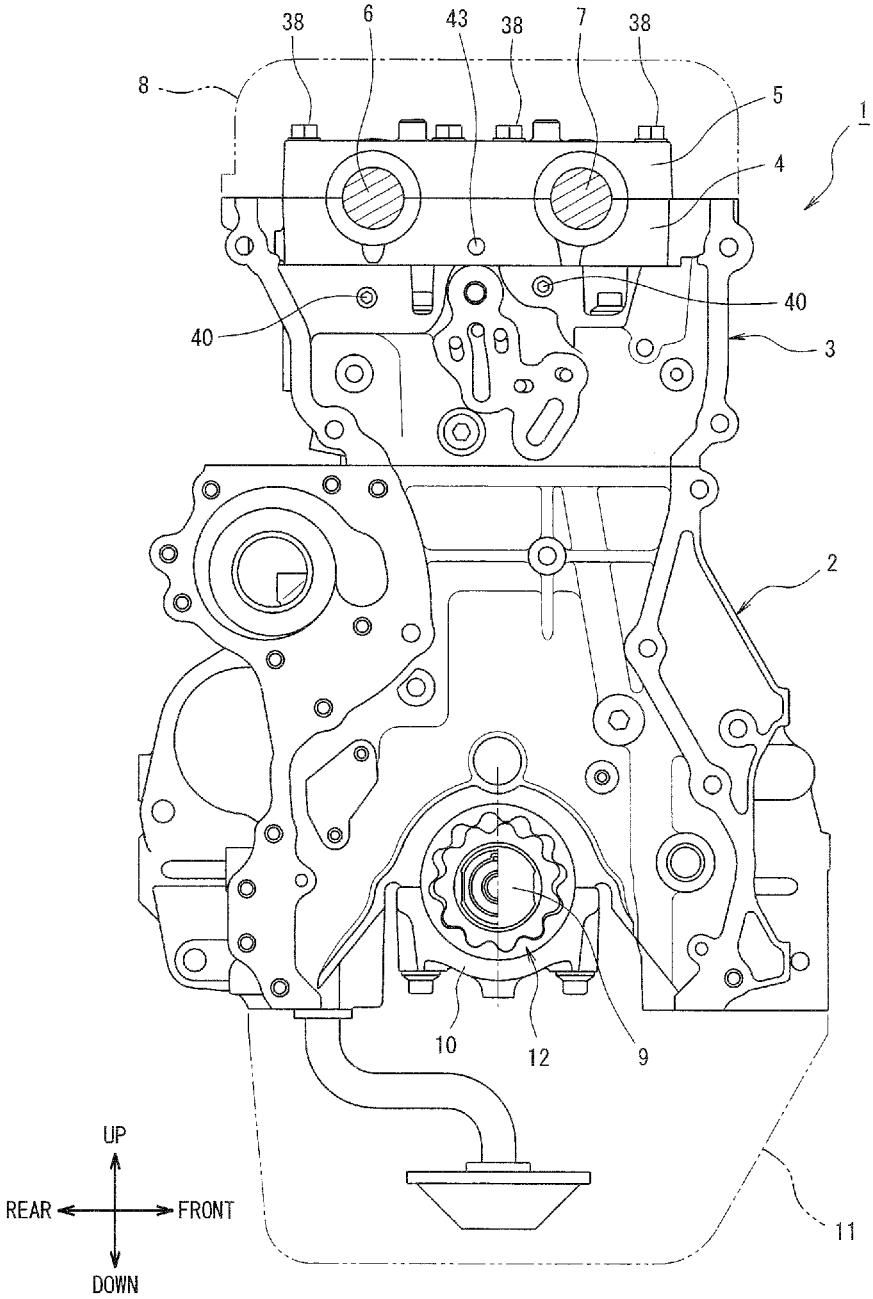
FIG. 1 is a front view of an engine to which an oiling structure for engine according to an embodiment of the present invention is applied.
Figure 2:
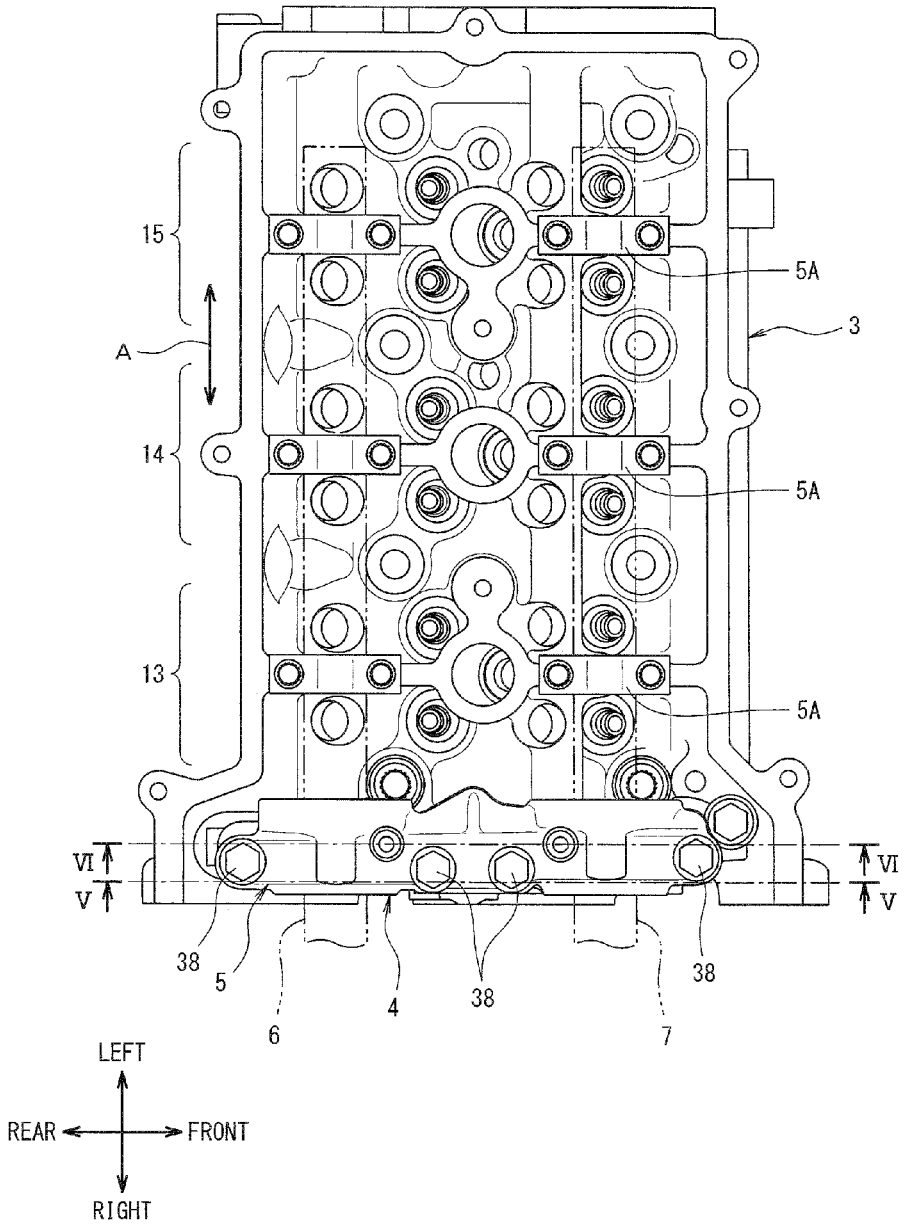
FIG. 2 is a plan view showing a state in which a cam shaft (indicated by a virtual line), a lower cam housing and an upper cam housing are assembled to a cylinder head in an engine to which an oiling structure for engine according to an embodiment of the present invention is applied.
Figure 3:
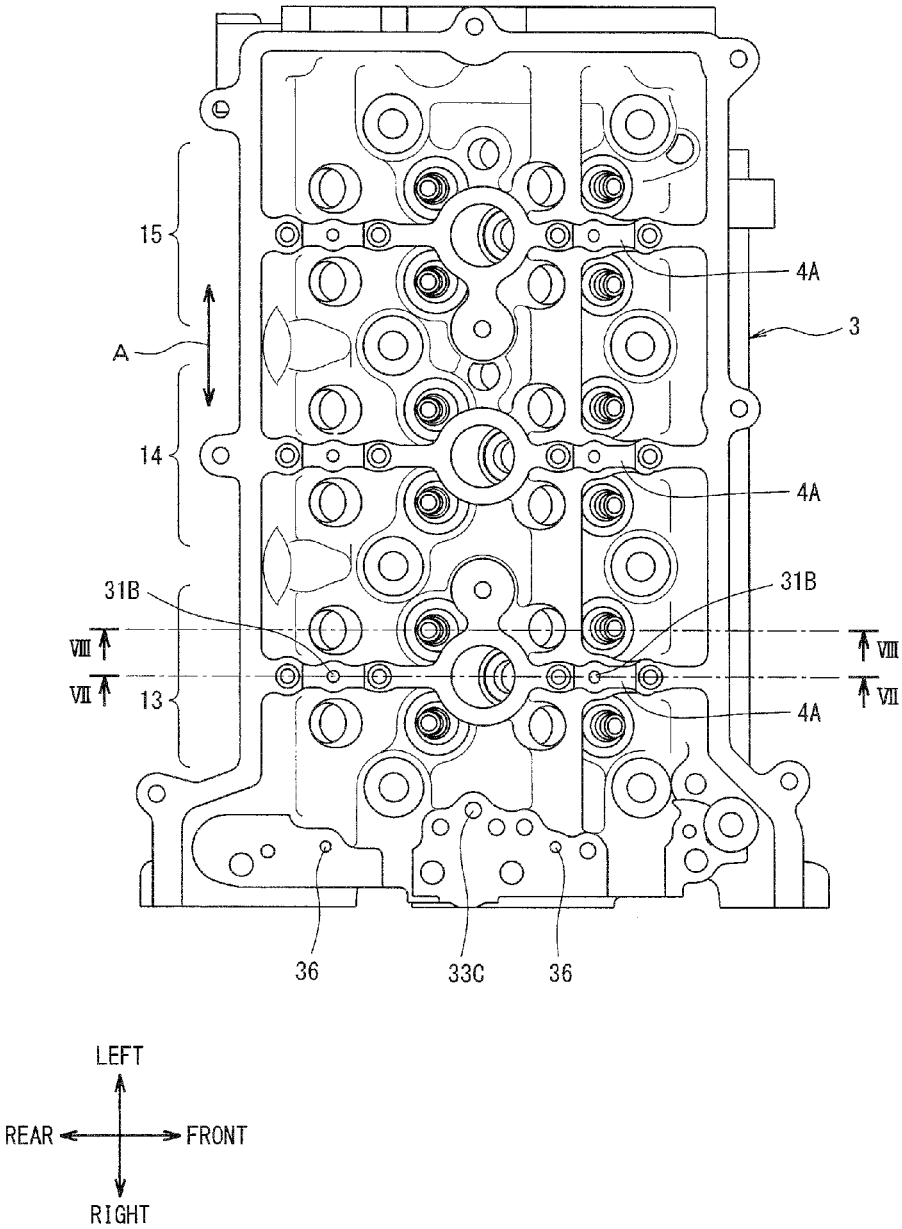
FIG. 3 is a plan view of a cylinder head in an engine to which an oiling structure for engine according to an embodiment of the present invention is applied.

As shown in FIG. 1 to FIG. 3, the engine 1 of the present embodiment is equipped with a cylinder block 2, a cylinder head 3 arranged on the cylinder block 2, lower cam housings 4, 4A (see FIG. 3) arranged at an upper portion of the cylinder head 3, an upper cam housing 5 arranged on the lower cam housing 4, an upper cam housing 5A (see FIG. 2) arranged on the lower cam housing 4A, a cam shaft 6 on an air intake side, a cam shaft 7 on an exhaust side, a cylinder head cover 8 (see FIG. 1) arranged to cover an upper portion of the cylinder head 3, a crank shaft 9 axially supported to be freely rotatable at a lower portion of the cylinder block 2, a crank shaft bearing 10 for axially supporting the crank shaft 9 at the lower portion of the cylinder block 2, an oil pan 11 provided at a lower side of the cylinder block 2, and an oil pump 12 provided at one end of the crank shaft 9.

Figure 8:
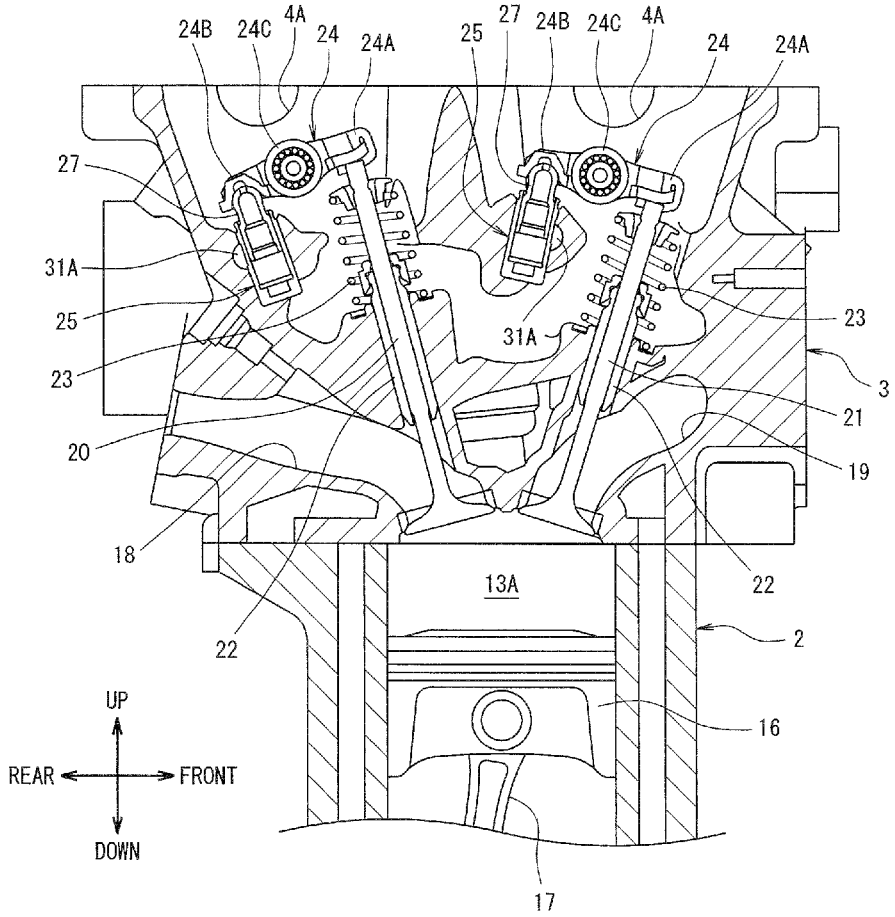
FIG. 8 is a cross sectional view along VIII-VIII line in FIG. 2.

As shown in FIG. 2 and FIG. 3, the cylinder block 2 (see FIG. 1) and the cylinder head 3 have, in their interior, a first cylinder formation region 13 in which a first cylinder 13A (see FIG. 8) is formed, a second cylinder formation region 14 in which a second cylinder not shown in the figure is formed, and a third cylinder formation region 15 in which a third cylinder not shown in the figure is formed. As shown in FIG. 8, inside the first cylinder 13A (the second cylinder, the third cylinder), respectively, an up and down moving piston 16 is linked to the crank shaft 9 via a connecting rod 17, such that a reciprocating motion of the piston 16 is converted into a rotational motion and conveyed.

As shown in FIG. 8, at positions respectively corresponding to the first cylinder 13A (the second cylinder, the third cylinder) in the cylinder head 3, air intake valves 20 and exhaust valves 21 for opening and closing openings in communication with an air intake port 18 and an exhaust port 19 are provided. In the present embodiment, a pair of the air intake valves 20 and a pair of the exhaust valves 21 are provided at each cylinder. These air intake valves 20 and exhaust valves 21 are provided to be capable of being moved forward and backward in axial directions by valve guides 22, and biased in directions for pulling up (valve closing directions) by valve springs 23.

(Rocker Arm)

As shown in FIG. 8, in the present embodiment, to an upper end portion of each of the air intake valve 20 and the exhaust valve 21, a lower face of one end portion 24A of a rocker arm 24 is arranged to be abutting. The other end portion 24B of this rocker arm 24 is supported by abutting to a tip end of a plunger 27 of a lash adjuster 25. That is, the rocker arm 24 is supported at the tip end portion of the plunger 27 that is to be a swinging center (a pivot point) at the other end portion 24B side. At a middle of the rocker arm 24, a pressed roller 24C is axially supported to be freely rotatable. This pressed roller 24C is protruding from an upper face of the rocker arm 24, and made to be abutted by a cam (not shown in the figure) provided at the cam shaft 6 on the air intake side or the cam shaft 7 on the exhaust side.

(Lash Adjuster)

Figure 4A:
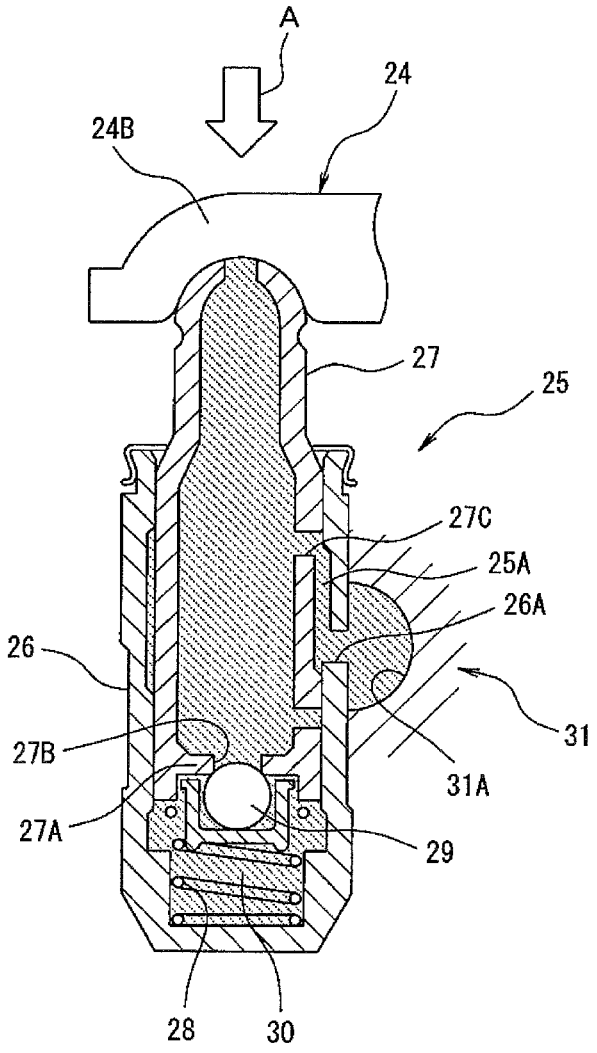
FIG. 4A is a cross sectional view of a lash adjuster.
Figure 4B:
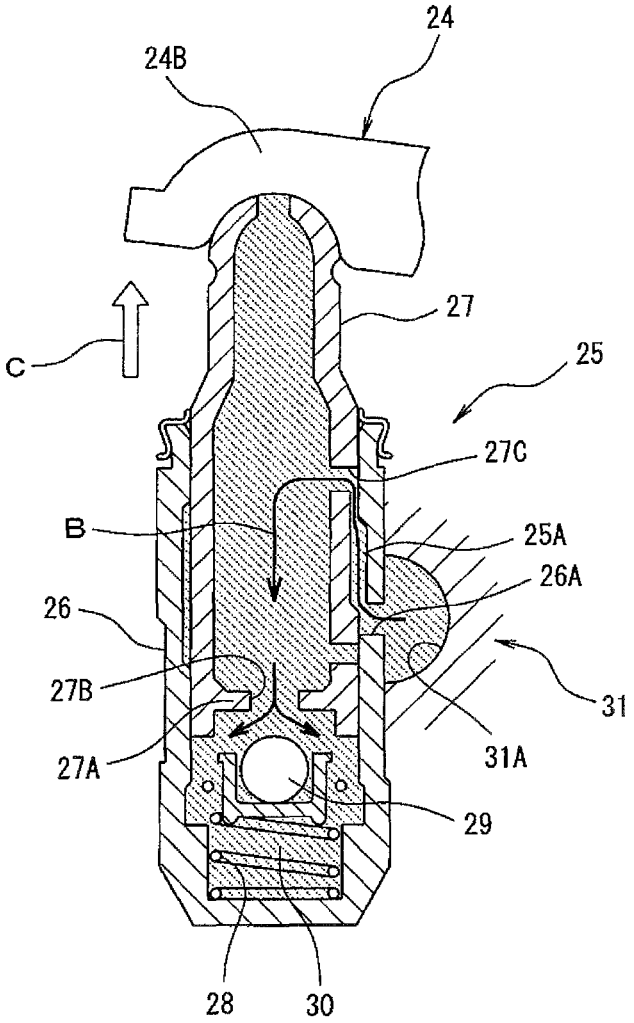
FIG. 4B is a cross sectional view showing an operation in which a plunger follows a rocker arm in a lash adjuster.

As shown in FIG. 4A and FIG. 4B, the lash adjuster 25 is equipped with a main body portion 26 in a cylindrical vessel shape, a plunger 27 of an approximately tubular shape which is fit inside the main body portion 26 and movable in an axial direction, a plunger spring 28 intermediating between a bottom portion of the main body portion 26 and the plunger 27, and a check ball 29 for carrying out opening and closing of an opening 27B formed at a center of a bottom portion 27A of the plunger 27 by being biased by the plunger spring 28.

In the main body portion 26 and the plunger 27, oil holes 26A and 27C are formed. Also, between an inner wall of the main body portion 27 and an outer wall of the plunger 27, an oil passage 25A for connecting these oil holes 26A and 27C is formed. The oil hole 26A is connected to be in communication with an oil passage for lash adjuster 31 to be described later. A space 30 in which the plunger spring 28 is arranged at the bottom portion of the main body portion 26 will function as a high pressure chamber. That is, this space 30 will become a high pressure chamber that is hard to be compressed even when a pressing force (shown by A in the figure) is received from the rocker arm 24 at a tip end of the plunger 27, by blocking the opening 27B of the bottom portion 27A of the plunger 27 with the check ball 29.

Also, as shown in FIG. 4B, in the case where the rocker arm 24 has moved to an upper side in the figure by receiving an influence from the air intake valve 20 or the exhaust valve 21 and the like, a pressure inside the space 30 will be lowered and the oil will flow in from the oil hole 26A (the flow of the oil is indicated by an arrow line B). Then, the plunger 27 will follow the other end portion 24B of the rocker arm 24 as indicated by an arrow C. At this point, the check ball 29 opens the opening 27B so that the oil will flow into the space 30. Then, in the case where the rocker arm 24 swings and a pressing force is exerted on the tip end of the plunger 27 from the other end portion 24B, because the opening 27B of the bottom portion 27A of the plunger 27 is blocked by the check ball 29, inside the space 30 will become a high pressure so that it becomes difficult for the plunger 27 to be pushed down any further.

(Main Oil Gallery, Oil Entry Passage and Oil Passage for Lash Adjuster)

Figure 5:
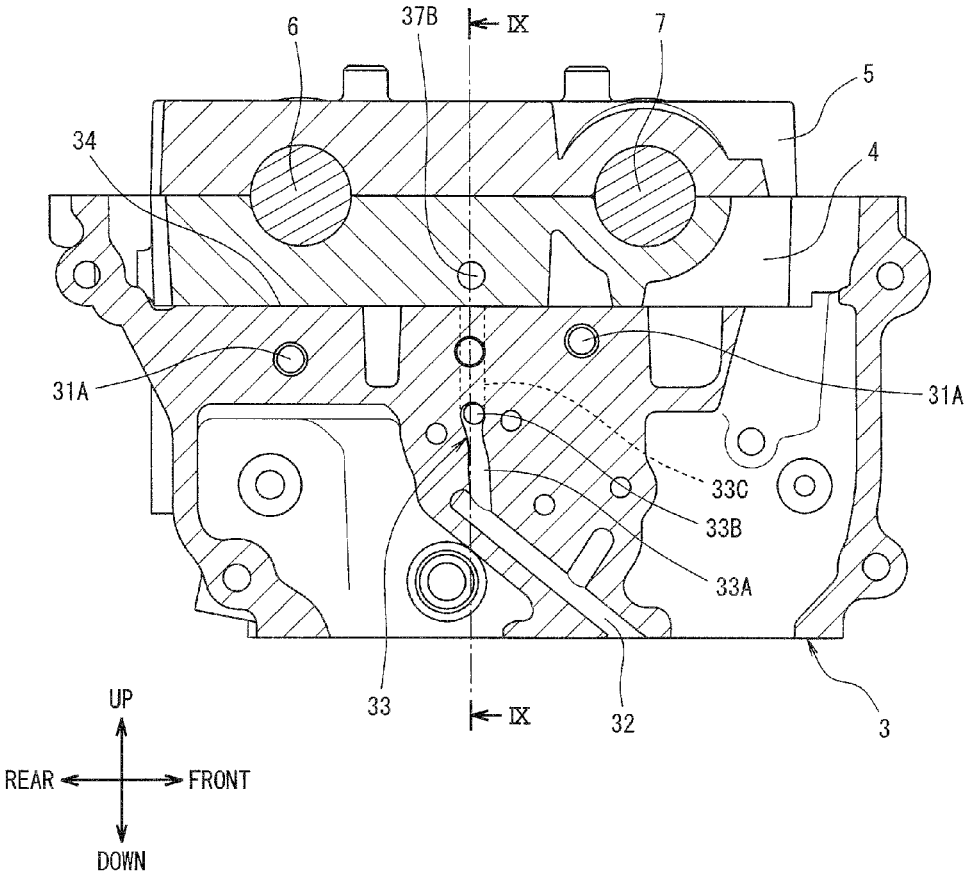
FIG. 5 is a cross sectional view along V-V line in FIG. 2.

FIG. 5 is a V-V line cross sectional view of FIG. 2. As shown in FIG. 5, in the cylinder head 3, a main oil gallery 32 is formed. This main oil gallery 32 is in communication with an output side of the oil pump 12 shown in FIG. 1. It is made such that the oil ejected from the oil pump 12 will be lead to the above noted lash adjuster 25 side and a cam journal not shown in the figure via the main oil gallery 32. As shown in FIG. 5, in the cylinder head 3, an oil entry passage 33 in communication with the main oil gallery 32 is formed. The oil entry passage 33 is configured from a first oil entry passage 33A formed along an up and down direction which is in communication with an upper end portion of the main oil gallery 32, a second oil entry passage 33B formed along a left and right direction of a vehicle body which is in communication with an upper end of the first oil entry passage 33A, and a third oil entry passage 33C formed along an up and down direction which is in communication with the second oil entry passage 33B and which is opening at a joint surface 34 with the lower cam housing 4 of the first cylinder formation region 13 at an upper face of the cylinder head 3.

Figure 7:
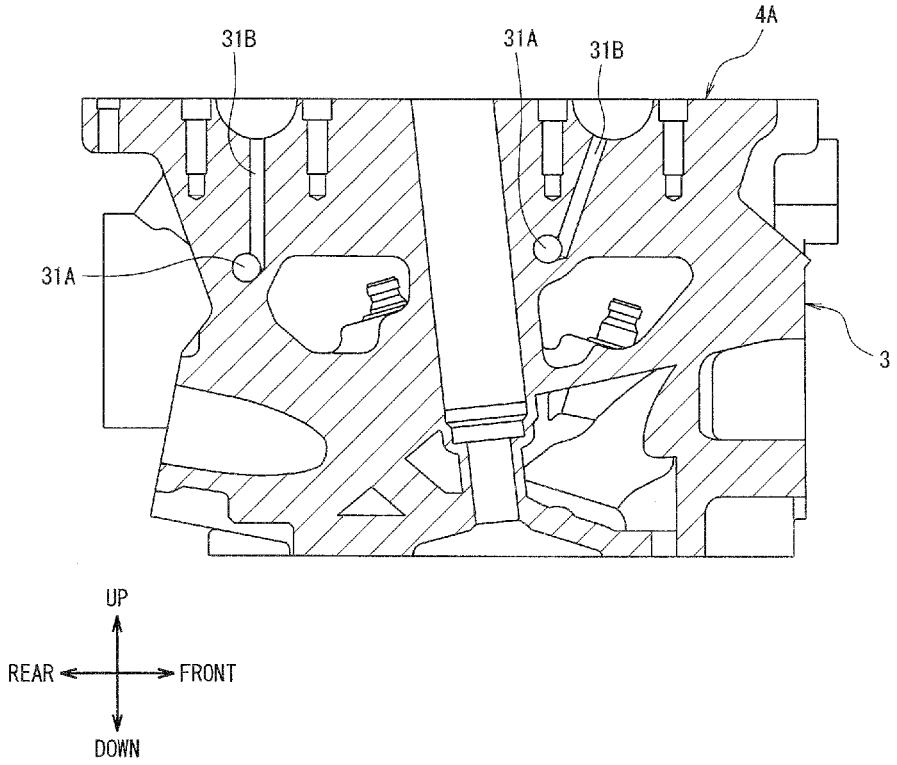
FIG. 7 is a cross sectional view along VII-VII line in FIG. 3.

Also, in the cylinder head 3, oil passages for lash adjusters 31 are formed separately from the above noted oil entry passage 33. As shown in FIG. 4A, FIG. 4B and FIG. 8, the oil passages for lash adjusters 31 are equipped with first oil passages for lash adjusters 31A which are connected to be in communication with the oil holes 26A of the lash adjusters 25 arranged at front and rear in the cylinder head 3. Also, as shown in FIG. 7, the oil passages for lash adjusters 31 are equipped with second oil passages for lash adjusters 31B which have lower end portions in communication with the first oil passages for lash adjusters 31A and which have upper end portions opening to a cam support surface (a bearing surface) of the lower cam housing 4A that is formed integrally with the cylinder head 3. Note that, in the present embodiment, the first oil passages for lash adjusters 31A are formed by the drilling from a right side end face of the cylinder head 3. Then, as shown in FIG. 1, the openings of the drilling at the right side end face of the cylinder head 3 are blocked by stoppers 40.

(First Upper Oil Passages)

Figure 6:
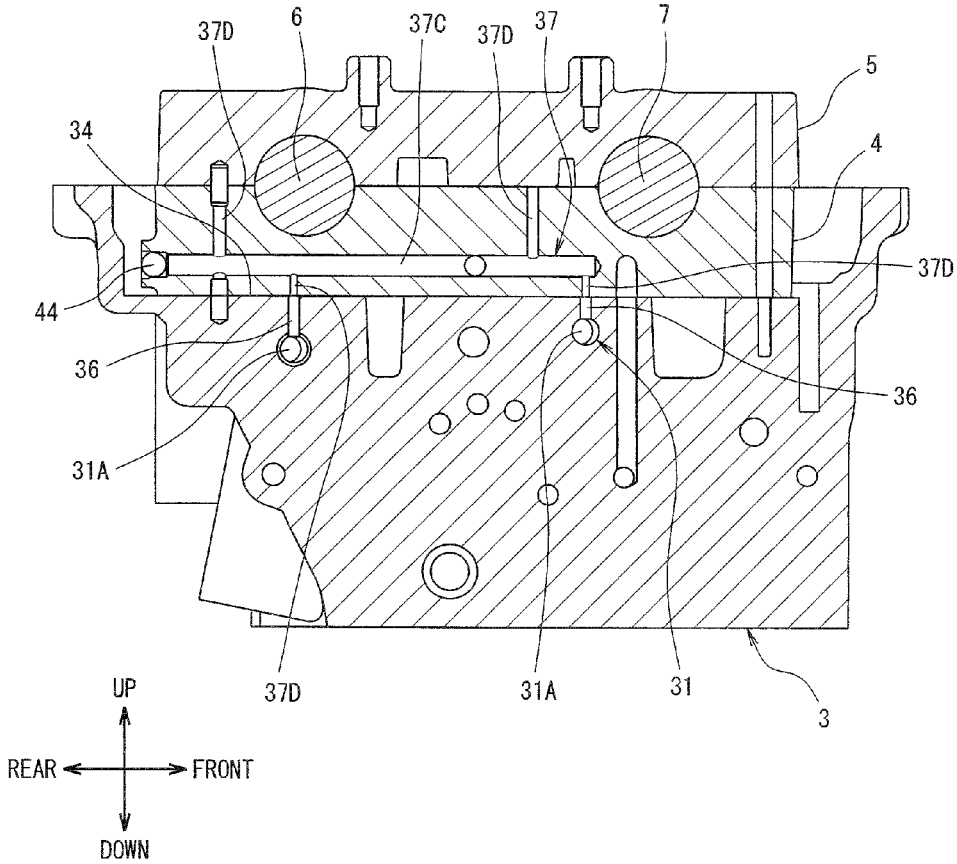
FIG. 6 is a cross sectional view along VI-VI line in FIG. 2.

Also, as shown in FIG. 6, in the cylinder head 3, a pair of first upper oil passages 36, with respective lower ends that are in communication with the first oil passages for lash adjusters 31A of the air intake side and the exhaust side and respective upper ends that are opening at the joint surface 34, are formed. These first upper oil passages 36 are set to be in communication with falling oil passages 37D to be described later.

(Lower Cam Housing)

As shown in FIG. 1, FIG. 5 and FIG. 6, the lower cam housing 4 is arranged to be extending along a vehicle front and rear direction, on the joint surface 34 at one end portion (a right side end portion in a vehicle left and right direction) of a cylinder array direction A (see FIG. 2 and FIG. 3) in which the first cylinder 13A, the second cylinder and the third cylinder are arranged in a left and right direction, in an upper face of the cylinder head 3. This lower cam housing 4 is formed as a separate body from the cylinder head 3. Note that the other lower cam housing 4A is formed integrally with the cylinder head 3.

(Second Upper Oil Passage)

Figure 9:
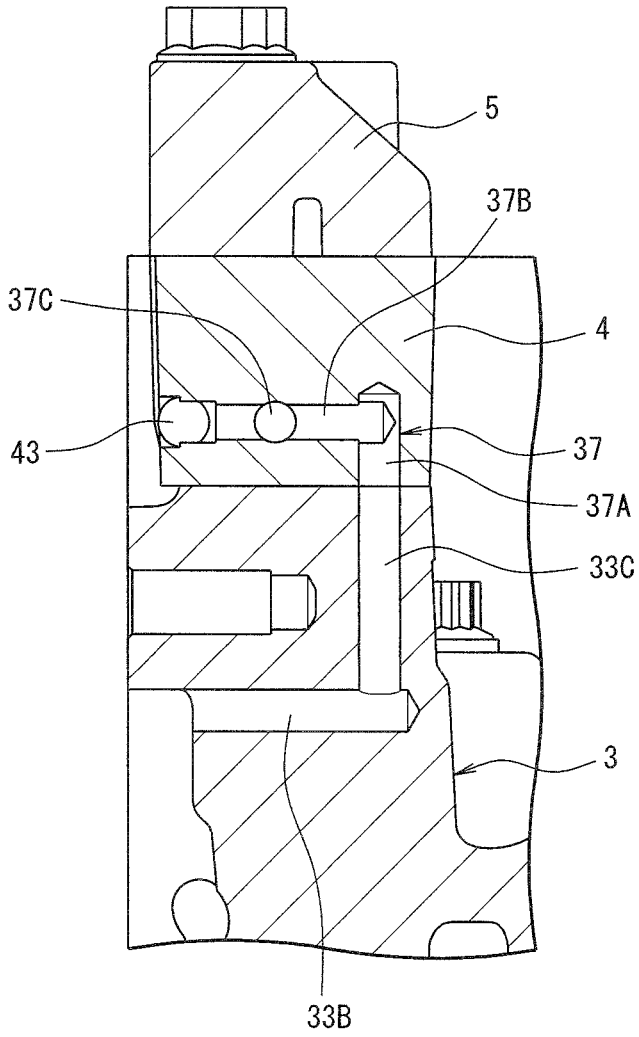
FIG. 9 is a cross sectional view along IX-IX line in FIG. 5.
Figure 12:
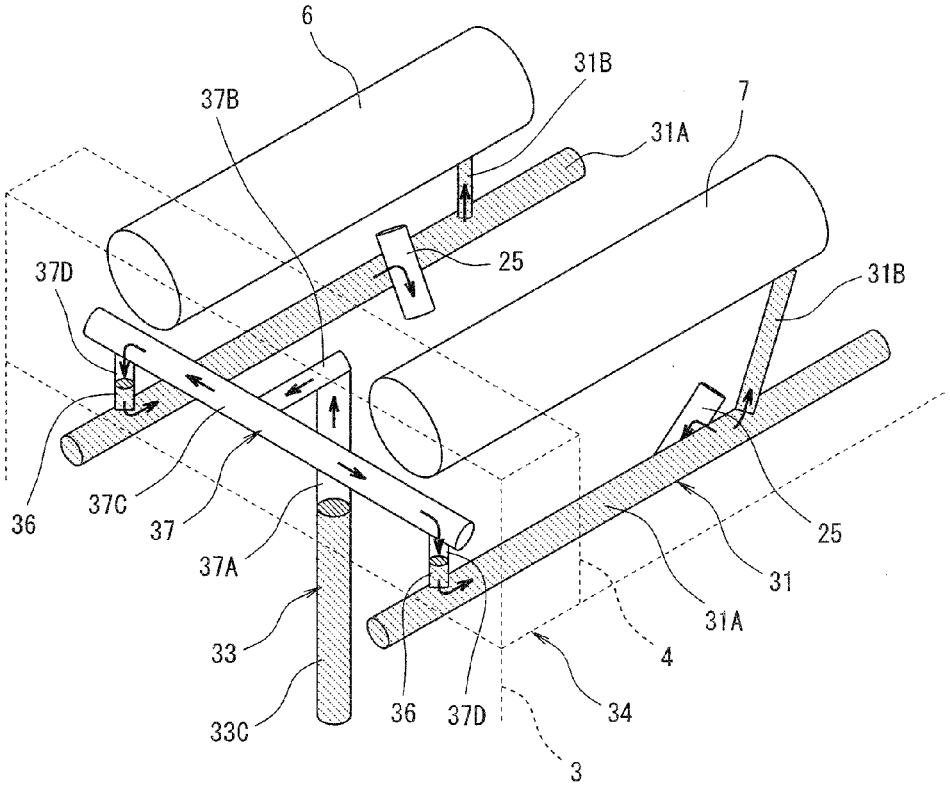
FIG. 12 is a perspective view schematically showing an oil entry passage, an oil passage for a lash adjuster, a first upper oil passage, and a second upper oil passage in an oiling structure for engine according to an embodiment of the present invention.
Figure 13:
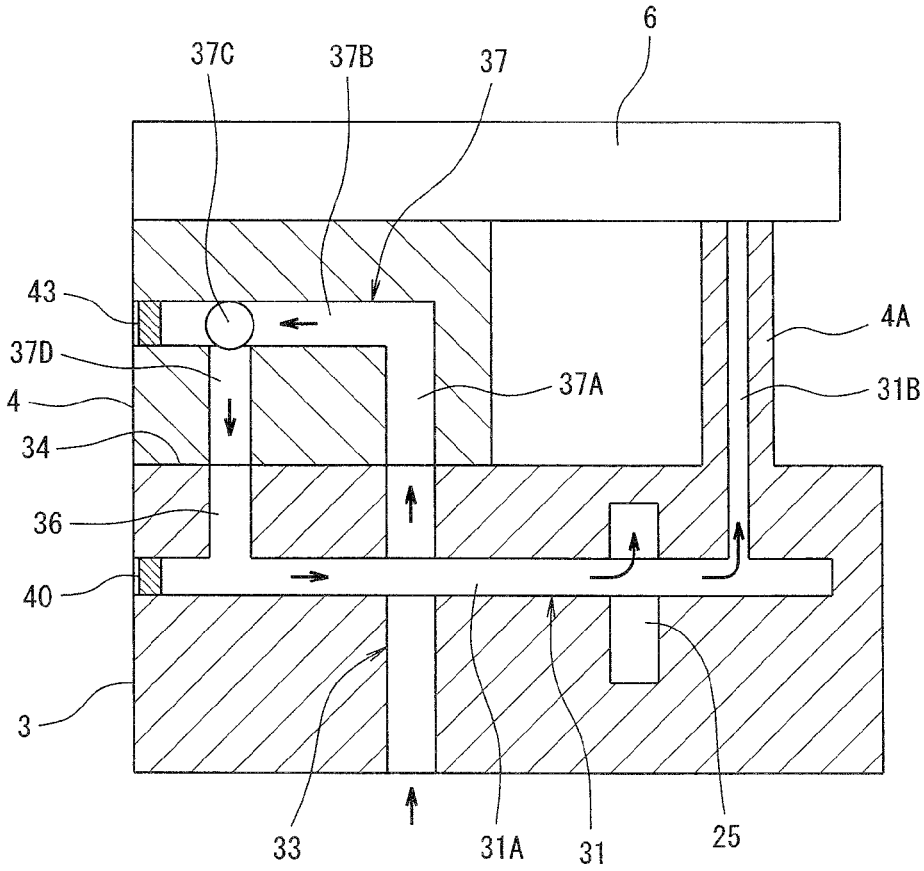
FIG. 13 is an explanatory diagram schematically showing an oil entry passage, an oil passage for a lash adjuster, a first upper oil passage, and a second upper oil passage in an oiling structure for engine according to an embodiment of the present invention.

As shown in FIG. 9, FIG. 12 and FIG. 13, in the lower cam housing 4, a second upper oil passage 37 is formed inside. The second upper oil passage 37 comprises a rising oil passage 37A to be in communication with the third oil entry passage 33C formed in the cylinder head 3, a connecting oil passage 37B in communication with a downstream end (an upper end portion) of the rising oil passage 37A, a horizontal oil passage 37C in communication with a downstream portion of the connecting oil passage 37B, and falling oil passages 37D in communication with the first upper oil passages 36 at the joint surface 34, which are formed along an up and down direction in such a way that they pass through the horizontal oil passage 37C.

Figure 10A:
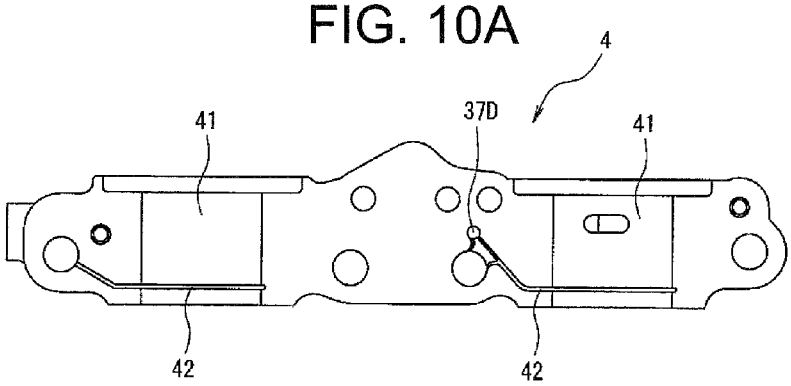
FIG. 10A is a plan view of a lower cam housing used in an oiling structure for engine according to the present embodiment.
Figure 10B:
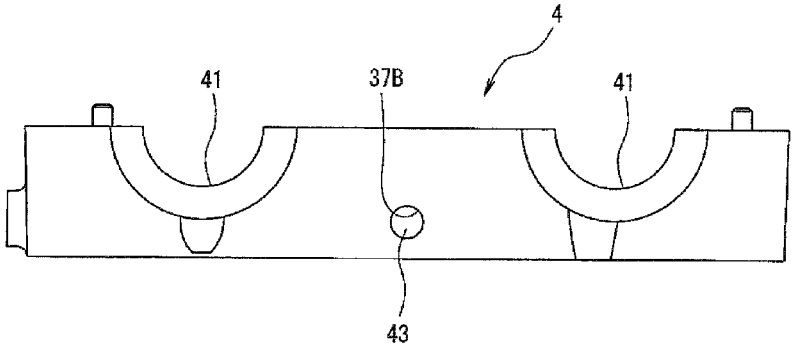
FIG. 10B is a front view of a lower cam housing used in an oiling structure for engine according to the present embodiment.
Figure 10C:
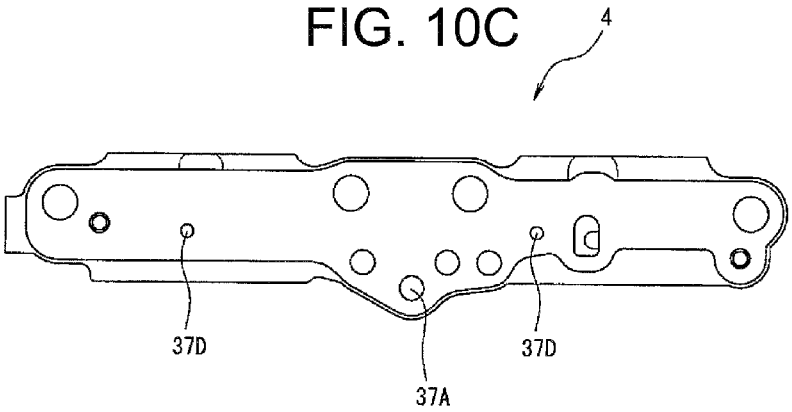
FIG. 10C is a bottom view of a lower cam housing used in an oiling structure for engine according to the present embodiment.

FIG. 10C is a bottom view of the lower cam housing 4. As shown in FIG. 10C, the falling oil passages 37D are formed in such a way that they pierce in an up and down direction through respective ones of the both end portions in a length direction of the lower cam housing 4. As shown in FIG. 10A and FIG. 10B, on the upper face of the lower cam housing 4, curved bearing portions 41, on which the cam shafts 6 and 7 of the air intake side and the exhaust side are axially supported, are formed. As shown in FIG. 10A, on inner faces of these bearing portions 41, oil supply grooves 42 that form oil passages in communication with the falling oil passages 37D are formed.

As shown in FIG. 10B, at a center of the lower cam housing 4, the connecting oil passage 37B is formed along a width direction (a left and right direction) of the lower cam housing 4. Note that, in the present embodiment, this connecting oil passage 37B is formed by the drilling along the width direction at the center portion of the lower cam housing 4. Note that, as shown in FIG. 10B, an opening end portion of the second upper oil passage 37B that is formed by the drilling is blocked by a stopper 43.

As shown in FIG. 10C, at a center of a length direction in a bottom face of the lower cam housing 4, the rising oil passage 37A is formed. This rising oil passage 37A can be formed by the drilling from a bottom face side of the lower cam housing 4. Also, as shown in FIG. 6, inside the lower cam housing 4, the horizontal oil passage 37C is formed to be extending in the length direction. This horizontal oil passage 37C is formed by the drilling from one end face side in the length direction of the lower cam housing 4. As shown in FIG. 6, an opening at one end face side in the length direction of this lower cam housing 4 is blocked by a stopper 44.

Figure 11A:
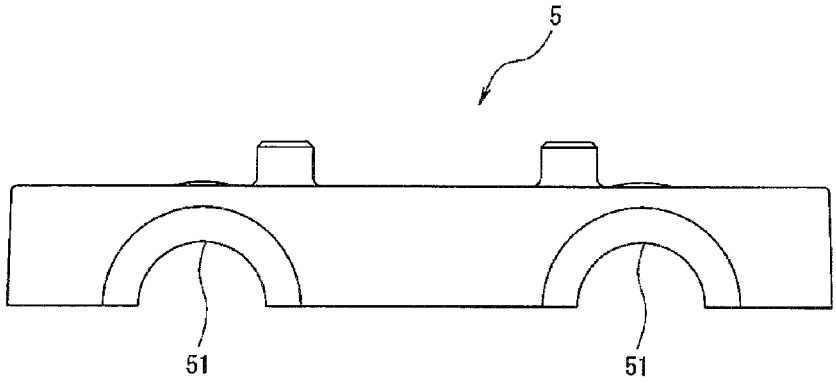
FIG. 11A is a front view of an upper cam housing used in an oiling structure for engine according to the present embodiment.
Figure 11B:
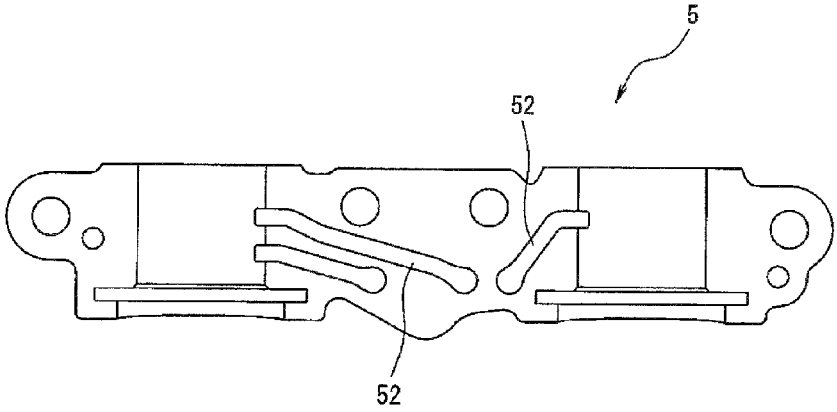
FIG. 11B is a bottom view of an upper cam housing used in an oiling structure for engine according to the present embodiment.

FIG. 11A is a front view of the upper cam housing 5, and FIG. 11B is a bottom view of the upper cam housing 5. As shown in FIG. 11A, in the upper cam housing 5, bearing portions 51 corresponding to the bearing portions 41 of the lower cam housing 4 are formed. As shown in FIG. 11B, on a bottom face of this upper cam housing 5, oil supply grooves 52 are formed at positions corresponding to inner faces of the bearing portions 41 of the lower cam housing or positions for forming oil passages. When this upper cam housing 5 is assembled on the lower cam housing 4, it becomes possible to supply the oil as lubricant oil to the bearing portions 41 and 51, by the oil supply grooves 42 and 52.

(Assembling Structure for Lower Cam Housing and Upper Cam Housing)

A bottom face of the lower cam housing 4 is arranged to be abutting on the joint surface 34 in the cylinder head 3. At this point, the third oil entry passage 33C on an upper face of the cylinder head 3 shown in FIG. 3 is set to be in communication with the rising oil passage 37A of the lower cam housing 4. Also, the first upper oil passages 36 formed at the joint surface 34 on an upper face of the cylinder head 3 are set to be in communication with the openings of the falling oil passages 37D on a bottom face of the lower cam housing 4. Then, as shown in FIG. 1 and FIG. 2, the lower cam housing 4 and the upper cam housing 5 are fixed by bolts 38 at plural locations with respect to the cylinder head 3.

(Effect and Operation)

In the oiling structure for engine of the present embodiment, it has the following effect and operation in conjunction with the start of the engine 1. First, in conjunction with the start of the engine 1, the oil pump 12 is activated and supplies the oil inside the oil pan 11 to the main oil gallery 32 side. As shown in FIG. 5, the oil ejected to the main oil gallery 32 is entered into the first oil entry passage 33A, the second oil entry passage 33B and the third oil entry passage 33C. Also, the downstream end of the third oil entry passage 33C is opening at the joint surface 34 of the cylinder head 3, and in communication with the rising oil passage 37A of the lower cam housing 4. For this reason, the oil passing through the third oil entry passage 33C is entered toward an upper side at the rising oil passage 37A. Then, the oil passing through the downstream end (the upper end portion) of the rising oil passage 37A passes through the connecting oil passage 37B, the horizontal oil passage 37C and the falling oil passages 37D, and enters into the first upper oil passages 36 that are in communication with the second upper oil passage 37 at the joint surface 34, and the first oil passage for lash adjuster 31A.

The oil entered into the first oil passage for lash adjuster 31A is entered into the lash adjuster 25 and the second oil passage for lash adjuster 31B. The lash adjuster 25 has an effect of canceling a valve clearance caused by the thermal expansion of the valve, by preventing a generation of a clearance between the rocker arm 24 and the tip end portion of the plunger 27 due to the entry of the oil from the first oil passage for lash adjuster 31A. Also, the oil entered into the second oil passage for lash adjuster 31B is supplied as the lubricant oil between the lower cam housing 4A that is formed integrally with the cylinder head 3, and the cam shafts 6 and 7.

In the case where the engine 1 is stopped, the oil pump 12 is stopped, and there is a possibility for the oil inside the main oil gallery 32, the oil entry passage 33, the rising oil passage 37A, the connecting oil passage 37B and the horizontal oil passage 37C to flow down to the oil pan 11 side. At this point, the oil inside the falling oil passages 37D in the second upper oil passage 37, the first upper oil passages 36, the first oil passages for lash adjusters 31A and the second oil passages for lash adjusters 31B will not flow down because an oil passage connected to the oil pan 11 side does not exist on a lower side of these oil passages. For this reason, the oil retained inside the falling oil passages 37D, the first upper oil passages 36, the first oil passages for lash adjusters 31A and the second oil passages for lash adjusters 31B will be supplied to the lash adjusters 25 when the engine 1 is re-started. For this reason, the remaining air inside the lash adjusters 25 will not occur at a time of the re-start of the engine 1, and it is possible to prevent the generation of the tappet sound and the adverse influence on the operations of the air intake valve 20 and the exhaust valve 21.

Namely, in the oiling structure for engine according to the present embodiment, by providing the first upper oil passages 36 and the second upper oil passage 37 (the falling oil passages 37D) at positions higher than the first oil passages for lash adjusters 31A, the oil remaining in these oil passages can be supplied to the lash adjusters 25 at a time of the stopping of the engine 1. For this reason, in the present embodiment, it is possible to prevent the oil inside the lash adjusters 25 from becoming empty. In this way, it is possible to secure the sufficient oil in the lash adjusters 25 at a time of the re-start of the engine, and it is possible to prevent the generation of the noise (tappet sound) at a time of the re-start of the engine 1. Also, in the present embodiment, the lower cam housing 4 is a separate body from the cylinder head 3 at a time of forming the complicated second upper oil passage 37 in the lower cam housing 4, so that it becomes easier to manufacture, by the drilling and the like for example, and it is possible to improve the productivity.

Also, in the present embodiment, the first oil passages for lash adjusters 31A comprise the (air intake side) oil passage for lash adjuster 31A that is in communication with the lash adjuster 25 to be used at the air intake side and the (exhaust side) oil passage for lash adjuster 31A that is in communication with the lash adjuster 25 to be used at the exhaust side. Then, in the present embodiment, the second upper oil passage 37 is in communication with each of the first upper oil passage 36 on the air intake side and the first upper oil passage 36 on the exhaust side. Because of such a structure in which the second upper oil passage 37 is formed inside the lower cam housing 4, the second upper oil passage 37 can be connected surely at the joint surface 34 with respect to the first upper oil passages 36 that are formed to be connected to each of the oil passages for lash adjusters 31A of both the air intake side and the exhaust side. Because the lower cam housing 4 can be fixed surely to the cylinder head 3, it is possible to prevent the oil leakage and the like. Also, in the present embodiment, because it suffices to fix the lower cam housing 4 to the cylinder head 3, it is possible to improve the assembling performance.

Other Embodiments

In the above, the embodiment has been described, but the description and the drawings that constitute a part of the disclosure of this embodiment should not be construed as one that is limiting this invention. From this disclosure, various alternative embodiments, implementations and operation techniques will become apparent to those skilled in the art.

For example, in the above described embodiment, the rising oil passage 37A, the connecting oil passage 37B, the horizontal oil passage 37C and the falling oil passages 37D in the second upper oil passage 37 are formed to be perpendicular to each other, in order to make it easier to manufacture each oil passage, but it is not limited to the above described structure, as long as it is a structure that has oil passages for leading the oil from the third oil entry passage 33C to the first upper oil passages 36 at positions higher than the joint surface 34.

Also, in the above described embodiment, it is a configuration in which the rocker arm 24 that is swung by the cam is supported by the lash adjuster 25, but it is possible to apply the present invention even in a configuration in which the cam is directly abutting to the lash adjuster 25.

The invention claimed is:

1. An oiling structure for an engine, including a cylinder head of the engine having a combination of intake and exhaust cam shafts, rocker arms adapted to swing in conjunction with rotations of said cam shafts, valves adapted to carry out opening and closing operations in conjunction with swing motions of the rocker arms, and housing pairs, with each cam housing pair including a lower cam housing and an upper cam housing arranged to rotatably support the cam shafts, wherein the rocker arms are each swingably supported at one-end thereof via hydraulic lash adjusters, and oil from an oil pump is guided to the lash adjusters through an oil passage system including oil passages for the lash adjusters formed in the cylinder head, wherein the lower cam housings include a lower cam housing formed as a separate body from the cylinder head and joined to the cylinder head, with a joint surface region between the cylinder head and the lower cam housing, and the oil passage system comprises: a set of first upper oil passages formed inside the cylinder head, extending from the oil passages for the lash adjusters to the joint surface region, the first upper oil passages having upstream ends thereof opened at the joint surface region; an oil entry passage formed in the cylinder head, for entry thereto of oil from the oil pump, the oil entry passage having a downstream end opened at the joint surface region; and a second upper oil passage formed in the lower cam housing to conduct oil to the joint surface region from above the joint surface region, the second upper oil passage having an upstream end thereof communicating with the oil entry passage at the joint surface region, and downstream ends of the second upper oil passage communicating with the set of first upper oil passages at the joint surface region, wherein the lash adjusters include an intake lash adjuster and an exhaust lash adjuster, the oil passages for the lash adjusters include an intake side oil passage communicating with a first oil hole at the intake lash adjuster, and an exhaust side oil passage communicating with a second oil hole at the exhaust lash adjuster, the set of first upper oil passages includes an intake side first upper oil passage communicating with the intake side oil passage, and an exhaust side first upper oil passage communicating with the exhaust side oil passage, and the downstream ends of the second upper oil passage include a first downstream end communicating with the intake side first upper oil passage, and a second downstream end communicating with the exhaust side first upper oil passage, and the oiling structure further comprising a first upwardly extending oil passage extending from the intake side oil passage to a first cam support surface of the lower cam housing supporting an intake cam shaft, and a second upwardly extending oil passage extending from the exhaust side oil passage to a second cam support surface of the lower cam housing supporting an exhaust cam shaft.

2. The oiling structure for an engine as claimed in claim 1, wherein said second upper oil passage is entirely arranged at positions higher than said joint surface region.

3. An oiling structure for an engine, including a cylinder head of the engine having a combination of intake and exhaust cam shafts, rocker arms adapted to swing in conjunction with rotations of the cam shafts, valves adapted to carry out opening and closing operations in conjunction with swing motions of the rocker arms, and cam housing pairs, with each cam housing pair including a lower cam housing and an upper cam housing arranged to rotatably support the cam shafts, wherein the rocker arms are each swingably supported at one-end thereof via hydraulic lash adjusters, and oil from an oil pump is guided to the lash adjusters through an oil passage system including oil passages for the lash adjusters formed in the cylinder head, wherein the lower cam housings include a lower cam housing formed as a separate body from the cylinder head and joined to the cylinder head, with a joint surface region between the cylinder head and the lower cam housing, and the lash adjusters include an intake lash adjuster and an exhaust lash adjuster, the oil passages for the lash adjusters include an intake side oil passage communicating with a first oil hole at the intake lash adjuster, and an exhaust side oil passage communicating with a second oil hole at the exhaust lash adjuster, wherein the oil passage system further comprises:

a pair of first upper oil passages formed in the cylinder head, extending from the intake side and exhaust side oil passages to the joint surface region, respectively, the pair of first upper oil passages each having an upstream end opened at the joint surface region;

an oil entry passage formed in the cylinder head, for entry of oil from the oil pump, the oil entry passage having a downstream end opened at the joint surface region;

a second upper oil passage formed in the lower cam housing to conduct oil to the joint surface region from above the joint surface region, the second upper oil passage having an upstream end thereof communicating with the oil entry passage at a first location in the joint surface region, and downstream ends of the second upper oil passage opened at second and third locations spaced from the first location in the joint surface region;

one of the first upper oil passages communicating with one of the downstream ends of the second upper oil passage at the second location, the other of the first upper oil passages communicating with another of the downstream ends of the second upper oil passage at the third location, and wherein a spacing between the third location and the first location is greater than a spacing between the second location and the first location, and wherein the other first upper oil passage has a greater passage length than the one first upper oil passage.

* * * * *